US007143038B2

(12) United States Patent
Katae

(10) Patent No.: US 7,143,038 B2
(45) Date of Patent: Nov. 28, 2006

(54) SPEECH SYNTHESIS SYSTEM

(75) Inventor: Nobuyuki Katae, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/070,301

(22) Filed: Mar. 3, 2005

(65) Prior Publication Data

US 2005/0149330 A1 Jul. 7, 2005

Related U.S. Application Data

(63) Continuation of application No. PCT/JP03/05492, filed on Apr. 28, 2003.

(51) Int. Cl.
*G10L 13/00* (2006.01)

(52) U.S. Cl. ..... 704/258; 704/260

(58) Field of Classification Search ..... 704/258, 704/260

See application file for complete search history.

(56) References Cited

U.S. PATENT DOCUMENTS

| | | | | |
|---|---|---|---|---|
| 5,864,812 | A * | 1/1999 | Kamai et al. | 704/268 |
| 6,240,384 | B1 * | 5/2001 | Kagoshima et al. | 704/220 |
| 6,760,703 | B1 * | 7/2004 | Kagoshima et al. | 704/262 |

FOREIGN PATENT DOCUMENTS

| | | |
|---|---|---|
| JP | 59-127147 | 7/1984 |
| JP | 04-005696 | 1/1992 |
| JP | 04-167749 | 6/1992 |
| JP | 04-243299 | 8/1992 |
| JP | 05-019790 | 1/1993 |
| JP | 07-181995 | 7/1995 |
| JP | 07-210186 | 8/1995 |
| JP | 10-049193 | 2/1998 |
| JP | 2001-100777 | 4/2001 |
| JP | EP 1 256 933 A2 | 11/2002 |
| JP | 2003-84800 | 3/2003 |

OTHER PUBLICATIONS

Nick Cambell, et al., "Chatr: a multi-lingual speech re-sequencing synthesis system", ATR Interpreting Telecommunications Research Laboratories, The Institute of Electronics, Information and Communication Engineers, Technical Report of IEICE, vol. 96, No. 39, SP96-7 (May 1996), pp. 45-52.

Nick Cambell, et al., "Stages of processin in CHATR speech synthesis", ATR Interpreting Telecommunications Research Laboratories, The Institute of Electronics, Information and Communication Engineers, Technical Report of IEICE, vol. 98, No. 423, SP98-84 (Nov. 1998), pp. 47-54.

* cited by examiner

*Primary Examiner*—Daniel Abebe
(74) *Attorney, Agent, or Firm*—Staas & Halsey LLP

(57) ABSTRACT

A speech synthesizing system producing a speech of an improved quality of voice by selecting a combination of speech segment most suitable for a synthesis speech unit sequence. The speech synthesizing system comprises a speech segment storage section where speech segment is stored, a speech segment selection information storage section where speech segment selection information including combinations of speech segment constituted of speech segment stored in the speech segment storage section for an arbitrary speech unit sequence and the appropriateness information representing the appropriatenesses of the combinations are stored, a speech segment selecting section for selecting a combination of speech segment most suitable for a synthesis parameter according to the speech segment selection information stored in the speech segment storage section, and a waveform generating section for generating speech waveform data from the combination of speech segment selected by the speech segment selecting section.

6 Claims, 8 Drawing Sheets

CONTENTS OF SPEECH SEGMENT SELECTION INFO.

| APPROPRIATE/ INAPPROPRIATE | SYNTHESIS TARGET PHONEME SEQUENCE | AVERAGE PITCH FREQUENCY | AVERAGE SYLLABLE DURATION | AVERAGE POWER | SPEECH SEGMENT SELECTION INFO. (X-Y) | | | | | | | | |
|---|---|---|---|---|---|---|---|---|---|---|---|---|---|
| APPROPRIATE | QyamatoQ | 200Hz | 120msec | -20dB | 1-2 | 1-3 | 1-4 | 1-5 | 3-15 | 3-16 | | | |
| APPROPRIATE | QyamatowAQ | 250Hz | 150msec | -20dB | 1-2 | 1-3 | 1-4 | 1-5 | 2-8 | 2-9 | 2-10 | 2-11 | |
| INAPPROPRIATE | QyamatowAQ | 200Hz | 115msec | -20dB | 1-2 | 1-3 | 1-4 | 1-5 | 3-15 | 3-16 | 2-10 | 2-11 | |
| | ....<br>.... | | | | | | | | | | | | |

*Fig. 6*

SPEECH SYNTHESIS SYSTEM

BACKGROUND OF THE INVENTION

This is a continuation of International Application PCT/JP2003/005492, with an international filing date of Apr. 28, 2003.

1. Field of the Invention

The present invention relates to a speech synthesis system wherein the most appropriate speech segment combination is found based on synthesis parameters from stored speech segment and concatenated, thereby generating a speech waveform.

2. Background Information

Speech synthesis technology is finding practical application in such fields as speech portal services and car navigation. Commonly, speech synthesis technology involves storing speech waveforms or parameterized speech waveforms, and appropriately concatenating and processing these to achieve a desired speech synthesis. The speech units to be concatenated are called synthesis units, and in previous speech synthesis technology, the primary method employed was to use a fixed-length synthesis unit.

For example, when a syllable is used as synthesis unit, the synthesis units for the synthesis target "Yamato" would be "ya", "ma" and "to". When a vowel-consonant-vowel concatenation (commonly called VCV) is used as the synthesis unit, joining at the midpoint of a vowel is assumed; the synthesis units for "yamato" would be "Qya", "ama", "ato", and "oQ", with "Q" signifying no sound.

Currently, however, the predominant method is to store a large inventory of speech data such as sentences and words spoken by a person, and in accordance with text input for synthesis, select and concatenate speech segment that has the longest matching segment therewith or speech segment not likely to sound discontinuous when concatenated (see, for example, Japanese Laid-open Patent Publication H10-49193). In this case, synthesis units are dynamically selected based on input text and speech data inventory. Methods of this type are collectively called corpus-based speech synthesis.

Because the same syllable can have different acoustical characteristics depending on the sounds before and after it, when a given sound is to be synthesized, a more natural speech synthesis is obtained by using speech segment such that the sounds before and after match over a wider range. Further, it is common to provide interpolatory segments for the purpose of making smooth joins when concatenating speech units. Because these interpolatory segments are artificial creations of speech segment that do not naturally exist, they lead to deterioration of speech quality. If the synthesis unit is lengthened, more appropriate speech segment can be used and the interpolatory segments that are the cause of speech quality deterioration can be made smaller, enabling improved quality of synthesized speech. However, preparing a database of all long speech units would result in a huge amount of data, for this reason making synthesis units a fixed length presents difficulties, and thus corpus-based methods as discussed above are prevalent.

FIG. 1 shows the configuration of a prior art example.

A speech segment storage unit 13 stores a large quantity of speech data such as sentences and words spoken by a person as speech waveforms or as parameterized waveforms. The speech segment storage unit 13 also stores index information for searching for stored speech segment.

Synthesis parameters are input into a phoneme selection unit 11. Synthesis parameters include speech unit sequences (synthesis target phoneme sequence), pitch frequency pattern, individual speech unit duration (phoneme duration) and power fluctuation pattern, as a result of input text analysis. The speech segment selection unit 11 selects the most appropriate combination of speech segment from the speech segment storage unit 13 based on input synthesis parameters. A speech synthesis unit 12 generates and outputs a speech waveform corresponding to the synthesis parameters using the combination of speech segment selected by the speech segment selection unit 11.

In a corpus-based method as described above, an evaluation function is established for the purpose of selection of the most appropriate speech segment from the speech segment inventory in the speech segment storage unit 13.

For example, let us suppose that the following two selections are possible as a speech segment combination satisfying the synthesis target phoneme sequence "yamato":

(1) "yama"+"to"

(2) "ya"+"mato"

These two speech segment combinations have the same synthesis unit length, as (1) is a combination of four phonemes plus two phonemes, and (2) is a combination of two phonemes plus four phonemes. However, in the case of (1) the point of connection between the synthesis units is between "a" and "t", and in the case of (2), the point of connection between the speech units is between "a" and "m". The "t" sound, which is an unvoiced plosive, contains a no sound portion; if such an unvoiced plosive is made the connection point, there is less likelihood of discontinuity in the synthesized speech. Therefore, in this case, combination (1), which offers "t" as a connection point between speech units, is the appropriate choice.

When combination (1), i.e., "yama"+"to", is selected, if the speech segment storage unit 13 has a plurality of phonemes for "to", selection of a "to" having the phoneme "a" directly before it would be most appropriate for the speech segment sequence to be synthesized.

Each selected speech segment is converted into a pitch frequency pattern and phoneme duration determined in accordance with input synthesis parameters. In general, because voice quality deteriorates are caused by excessive pitch frequency conversion or phoneme duration conversion, it is preferable that speech segments having pitch frequency and phoneme duration close to the targeted pitch frequency and phoneme duration are selected from the speech segment storage unit 13.

SUMMARY OF THE INVENTION

The speech synthesis system according to a first aspect of the present invention uses as input synthesis parameters required for speech synthesis, selects a combination of speech segment from a speech segment inventory, and concatenates each of the speech segment, thus generating and outputting a speech waveform for such synthesis parameters. It comprises a speech segment storage unit for storing speech segment, a speech segment selection information storage unit for storing, with respect to a given speech unit sequence, speech segment selection information including a speech segment combination constituted by speech segment stored in the speech segment storage unit and information regarding appropriateness of such combination, a speech segment selection unit for selecting from the speech segment storage unit the most appropriate speech segment combination for input synthesis parameters based on speech segment selection information stored in the speech segment selection information storage unit, and a speech synthesis unit for generating and outputting speech waveform data based on the speech segment combination selected by the speech segment selection unit.

In this case, because a speech segment combination that is most appropriate for each individual synthesis target speech unit sequence is stored as speech segment selection information, generation of high-quality synthesized speech is possible without storing a large amount of speech segment in the speech segment storage unit.

The speech synthesis system according to a second aspect of the present invention is the speech synthesis system according to the first aspect, wherein, when the speech segment selection information storage unit contains speech segment selection information to the effect that a speech unit sequence that matches the speech unit sequence is contained in input system parameters and the speech segment combination thereof is the most appropriate, such speech segment combination is selected; when the speech segment selection information storage unit does not contain speech segment selection information to the effect that a speech unit sequence that matches the speech unit sequence is contained in input system parameters and the speech segment combination thereof is the most appropriate, prescribed selection means is used to create potential speech segment combinations from the speech segment storage unit.

In this case, using a speech segment combination selected based on speech segment selection information stored in the speech segment selection information storage unit enables generation of a high-quality synthesized speech for the relevant synthesis target speech unit sequence; for synthesis target speech unit sequences that are not stored in the speech segment selection information storage unit, potential speech segment combinations are created and user makes selection of the most appropriate one.

The speech synthesis system according to a third aspect of the present invention is the speech synthesis system according to the second aspect, further comprising an acceptance/rejection judgment reception unit for receiving a user's appropriate/inappropriate judgment with respect to a potential speech segment combination created by the speech segment selection unit and a speech segment selection information editing unit for storing in the speech segment selection information storage unit speech segment selection information including speech segment combinations created by the speech segment selection unit based on user appropriate/inappropriate judgment received by the acceptance/rejection judgment reception unit and information regarding the appropriateness/inappropriateness thereof.

In this case, a user makes judgment regarding whether a potential speech segment combination generated at the speech segment selection unit is appropriate or not, and a speech waveform matching user preferences is generated.

The speech synthesis method according to a fourth aspect of the present invention uses as input synthesis parameters required for speech synthesis, selects a combination of speech segment from a speech segment inventory, and concatenates each of the speech segment, thus generating and outputting a speech waveform for such synthesis parameters. It comprises a step for storing speech segment, a step for storing, with respect to a given speech unit sequence, speech segment selection information including a speech segment combination constituted by stored speech segment and information regarding appropriateness of such combination, a step for selecting from a speech segment inventory the most appropriate speech segment combination for input synthesis parameters based on speech segment selection information, and step for generating speech waveform data based on the speech segment combination selected by the speech segment selecting step.

In this case, because speech segment that is most appropriate for each individual speech unit sequence is stored as speech segment selection information, generation of high-quality synthesized speech is possible without requiring an excessive amount of speech segment.

The speech synthesis method according to a fifth aspect of the present invention is the speech synthesis method according to a fourth aspect, further comprising a step for creating, with respect to a given speech unit sequence, potential speech segment combinations constituted by stored speech segment, a step for receiving a user's appropriate/inappropriate judgment with respect to the created speech segment combinations, and a step for storing as speech segment selection information a speech segment combination created based on user appropriate/inappropriate judgment and information regarding the appropriateness/inappropriateness thereof.

In this case, using a speech segment combination selected based on stored speech segment selection information enables generation of a high-quality synthesized speech for the relevant synthesis target speech unit sequence; for synthesis target speech unit sequences that are not stored, potential speech segment combinations are created and user makes selection of the most appropriate one.

The speech synthesis program according to a sixth aspect of the present invention uses as input synthesis parameters required for speech synthesis, selects a combination of speech segment from a speech segment inventory, and concatenates each of the speech segment, thus generating and outputting a speech waveform for such synthesis parameters. It comprises a step for storing speech segment, a step for storing, with respect to a given speech unit sequence, speech segment selection information including a speech segment combination constructed using a speech segment inventory and information regarding appropriateness of such combination, a selection step for selecting from a speech segment inventory the most appropriate speech segment combination for input synthesis parameters based on speech segment selection information, and a step for generating speech waveform data based on the speech segment combination selected by the speech segment selecting step.

In this case, because speech segment that is most appropriate for each individual synthesis target speech unit sequence is stored as speech segment selection information, generation of high-quality synthesized speech is possible without having to store an excessive amount of speech segment, and this program can cause a standard personal computer or other computer system to function as a speech synthesis system.

These and other objects, features, aspects and advantages of the present invention will become apparent to those skilled in the art from the following detailed description.

BRIEF DESCRIPTION OF THE DRAWINGS

Referring now to the attached drawings which form a part of this original disclosure:

FIG. 6 is a drawing showing one example of speech segment selection information.

DETAILED DESCRIPTION OF THE PREFERRED EMBODIMENTS

An evaluation function is created that incorporates a plurality of elements with respect to speech segment to be selected, including speech segment length and phoneme characteristics, preceding and following phonemes, pitch frequency, and phoneme duration. However, it is difficult to create an evaluation function that is suitable for all input for synthesis; as a result, there may be cases where the most appropriate speech segment combination is not necessarily selected from among possible combinations, leading to deterioration of speech quality.

It is an object of the present invention to provide a speech synthesis system with improved speech quality through selection of the most appropriate speech segment combination for a synthesis target speech unit sequence.

Figure 1:
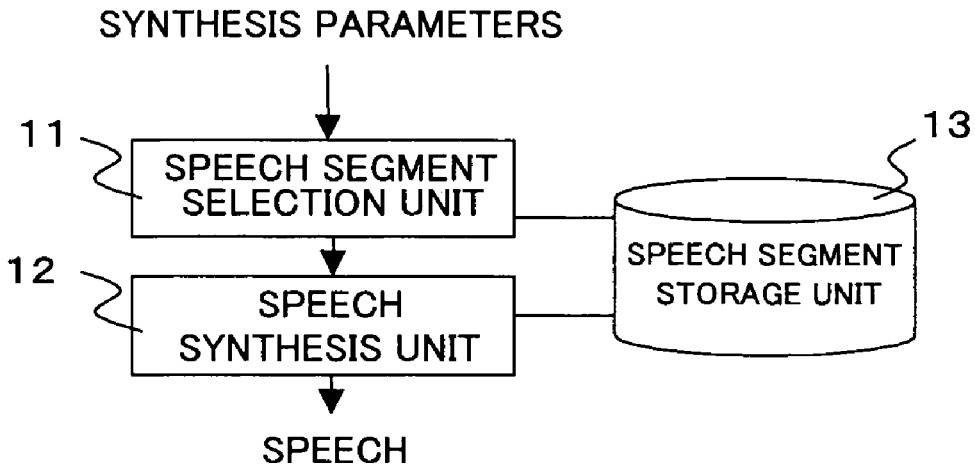
FIG. 1 is a simplified block drawing showing a schematized prior art example.
Figure 2:
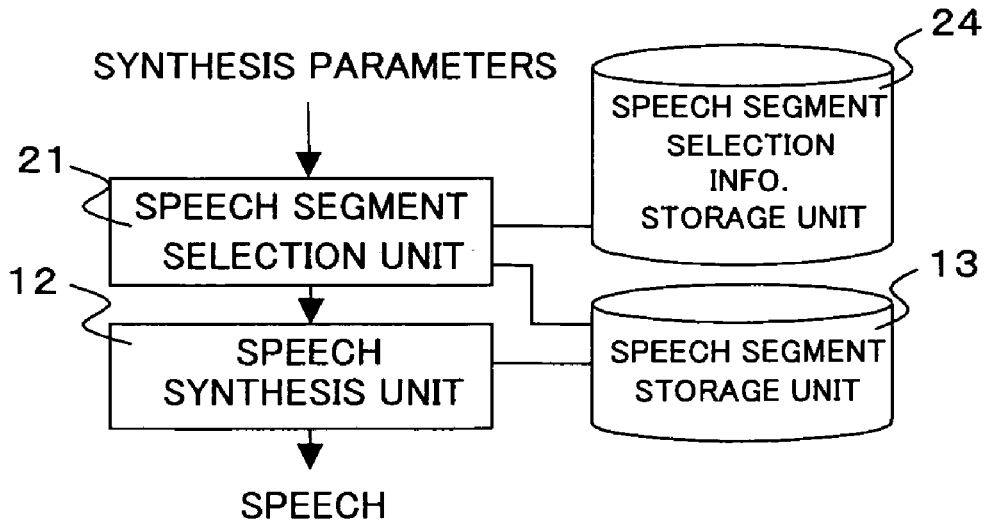
FIG. 2 is a schematic drawing showing a first principle of the present invention.

Principle Constitution (1) FIG. 2 shows a schematic drawing based on a first principle of the present invention.

This constitution comprises a speech segment storage unit 13 where a large inventory of speech waveforms or parameterized speech waveforms is stored based on speech data such as sentences and words spoken by a person, a speech segment selection unit 21 for selecting a combination of speech segment from the speech segment storage unit 13 based on input synthesis parameters, and a speech synthesis unit 12 for generating and outputting a speech waveform corresponding to the synthesis parameters using a speech segment combination selected by the speech segment selection unit 21.

Also included is a speech segment selection information storage unit 24 for storing speech segment selection information as combinations of speech segments stored in the speech segment storage unit 13 and information regarding the appropriateness thereof.

The speech segment selection unit 21, based on the synthesis target phoneme sequence included in input synthesis parameters, executes a search to determine whether speech segment selection information for the same phoneme sequence exists in the speech segment selection information storage unit 24; if speech segment selection information for the same phoneme sequence exists, the speech segment combination is selected. If speech segment selection information for the same phoneme sequence does not exist in the speech segment selection information storage unit 24, the most appropriate speech segment combination is selected from the speech segment storage unit 13 in the conventional manner using an evaluation function. If inappropriate speech segment selection information also exists, then the evaluation function is used to select the most appropriate from among speech segment combinations that are not inappropriate.

In the event that speech segment selection information for a phoneme sequence that partially matches a synthesis target phoneme sequence contained in input synthesis parameters is stored in the speech segment selection information storage unit 24, the speech segment selection unit 21 uses a speech segment combination stored as speech segment selection information only with respect to such matching portion; with respect to the remaining portions, the most appropriate speech segment combination is selected from the speech segment storage unit 13 in the conventional manner, using prescribed selection means. Conventional selection means include an evaluation function and evaluation table, but no particular limitations are placed thereupon.

Figure 5:
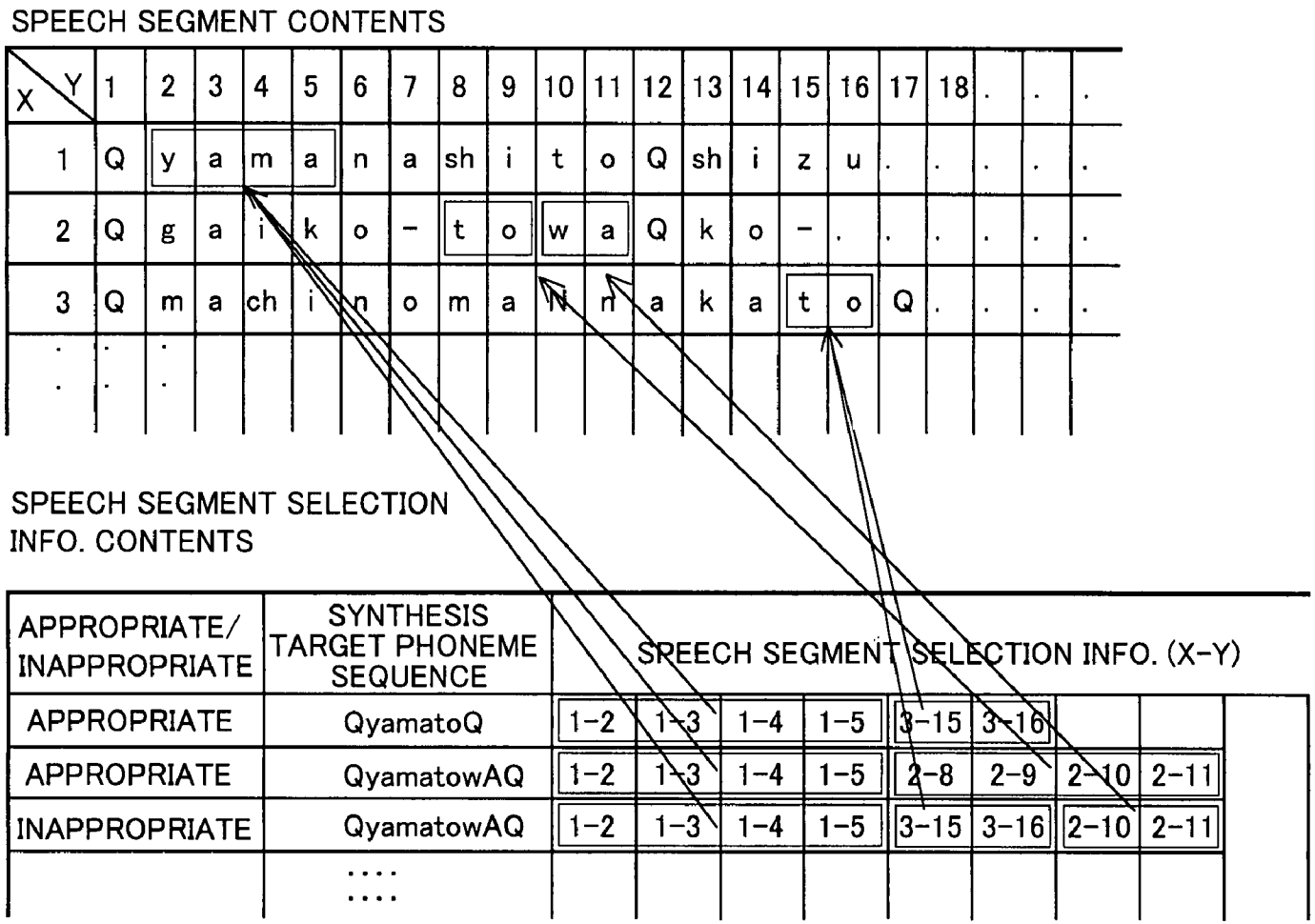
FIG. 5 is a drawing for describing the relationship between stored speech segment and speech segment selection information.

Speech segment selection information stored in the speech segment selection information storage unit 24 is constituted, for example, in the manner shown in FIG. 5.

The upper portion of FIG. 5 shows speech segment stored in the speech segment storage unit 13. X (lines) indicates sentence serial number and Y (columns) indicates phoneme serial number. For example, sentence no. 1 (X=1) indicates speech of the sentence "yamanashi to shizuoka," and the phoneme sequence constituting the sentence, i.e., "QyamanashitoQshizuoka," is represented in order, starting from the beginning, in Y=1~n. Here "Q" represents no sound.

As shown in the lower portion of FIG. 5, speech segment selection information stored in the speech segment selection information storage unit 24 shows the most appropriate speech segment combination with respect to a given synthesis target phoneme sequence using X-Y values for speech segment stored in the speech segment storage unit 13. For example, line 1 indicates that as a speech segment combination for constituting the synthesis target phoneme sequence "QyamatoQ", use of [X=1, Y=2] [X=1, Y=3] [X=1, Y=4] [X=1, Y=5] [X=3, Y=15] [X=3, Y=16] in the speech segment storage unit 13 is most appropriate. Further, line 2 indicates that as a speech segment combination for constituting the synthesis target phoneme sequence "QyamatowAQ", use of [X=1, Y=2] [X=1, Y=3] [X=1, Y=4] [X=1, Y=5] [X=2, Y=8] [X=2, Y=9] [X=2, Y=10] [X=2, Y=11] in the speech segment storage unit 13 is most appropriate.

The only difference between the synthesis target phoneme sequences of line 1 and line 2 of FIG. 5 is the presence of "wA"; it can be seen that because in sentence no. 2 of the speech segment storage unit 13, the consecutive phoneme sequence of "towa" is present, the speech segment considered most appropriate for the "to" portion has also changed.

Further, a speech segment combination that is inappropriate for a synthesis target phoneme sequence can be registered as speech segment selection information, with indications that a different speech segment combination should be selected. For example, as shown in line 3 of FIG. 5, registration is made in advance that use of [X=1, Y=2] [X=1, Y=3] [X=1, Y=4] [X=1, Y=5] [X=3, Y=15] [X=3, Y=16] [X=2, Y=10] [X=2, Y=11] in the speech segment storage unit 13 as a speech segment combination is inappropriate for the synthesis target phoneme sequence "QyamatowAQ".

The system can be configured so that, in addition to synthesis target phoneme sequence, average pitch frequency, average syllable duration, average power and other conditions can be registered as speech segment selection information; when input synthesis parameters meet these conditions, that speech segment combination is used. For example, as shown in FIG. 6, it is registered in the speech segment selection information storage unit 24 that for the synthesis target phoneme sequence "QyamatoQ", with synthesis parameters of average pitch frequency 200 Hz, average syllable duration 120 msec, and average power −20 dB, the speech segment combination of [X=1, Y=2] [X=1, Y=3] [X=1, Y=4] [X=1, Y=5] [X=3, Y=15] [X=3, Y=16] is most appropriate. Because even if input synthesis parameters do not completely match speech segment selection information conditions, so long as the deviation is limited, deterioration of voice quality will be within an allowable range, the system may be configured so that a prescribed threshold value is set, and a speech segment combination is not used only in cases of significant separation from this threshold value.

If the evaluation function is to be fine-tuned so that the most appropriate speech segment is selected for a given synthesis target phoneme sequence, there is the danger of an adverse effect on selection of speech segment for other synthesis target phoneme sequences; with the present invention, however, because speech segment selection information valid only for a specified synthesis target phoneme sequence is registered, the selection of a speech segment combination for other synthesis target phoneme sequences is not affected.

Figure 3:
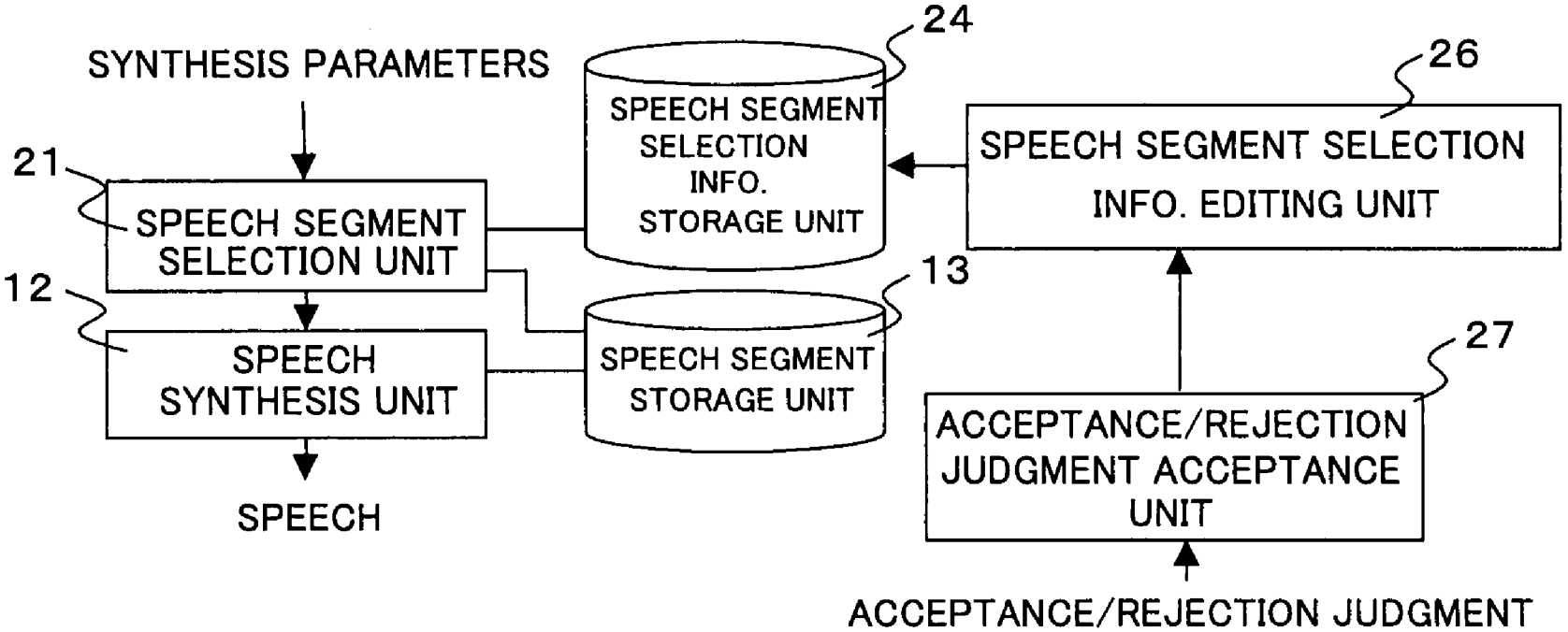
FIG. 3 is a schematic drawing showing a second principle of the present invention.

(2) FIG. 3 shows a schematic drawing based on a second principle of the present invention.

In comparing FIG. 3 with FIG. 2, which is a schematic drawing of a first principle of the present invention, we see that the following has been added: an acceptance/rejection judgment input unit 27 for accepting a user's judgment of acceptance/rejection with respect to synthesized speech output from the speech synthesis unit 12, and a speech segment selection information editing unit 26 for storing in the speech segment selection information storage unit 24 speech segment selection information regarding a speech segment combination based on a user's appropriate/inappropriate judgment received at the acceptance/rejection judgment input unit 27.

For example, when a speech segment combination is to be selected based on input synthesis parameters, if there is no speech segment selection information that matches the synthesis target phoneme sequence included in the synthesis parameters, the speech segment selection unit 21 creates potential combinations from speech segment in the speech segment storage unit 13. A user listens to synthesized speech output via the speech synthesis unit 12 and inputs an appropriate/inappropriate judgment via the acceptance/rejection judgment input unit 27. The speech segment selection information editing unit 26 then adds speech segment selection information from the speech segment selection information storage unit 24 based on a user's appropriate/inappropriate judgment input from the acceptance/rejection judgment input unit 27.

Figure 4:
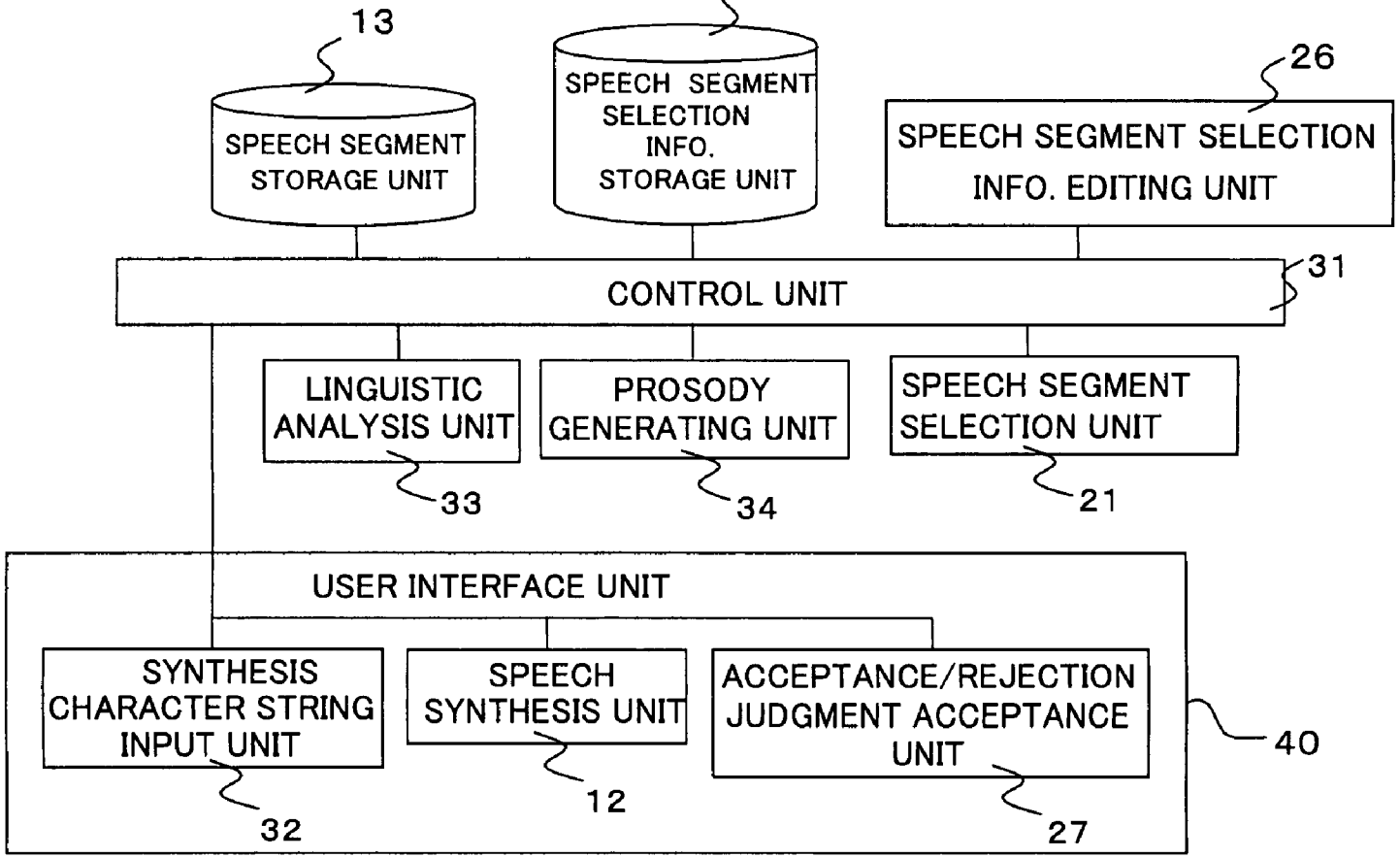
FIG. 4 is a control block diagram of a speech synthesis system employing a first embodiment of the present invention.

With such a constitution, a speech segment combination selected at the speech segment selection unit 21 can be made to conform to a user's settings, enabling construction of a speech synthesis system with higher sound quality. Example of speech synthesis system FIG. 4 shows a control block diagram of a speech synthesis system employing a first embodiment of the present invention.

This speech synthesis system is constituted by a personal computer or other computer system, and control of the various functional units is carried out by a control unit 31 that contains a CPU, ROM, RAM, various interfaces and the like.

The speech segment storage unit 13, where a large inventory of speech segment is stored, and the speech segment selection information storage unit 24, where speech segment selection information is stored, can be set on a prescribed region of a hard disk drive, magneto-optical drive, or other recording medium internal or external to a computer system, or on a recording medium managed by a different server connected over a network.

A linguistic analysis unit 33, a prosody generating unit 34, the speech segment selection unit 21 and speech segment selection information editing unit 26 and the like can be constituted by applications running on the computer memory.

Further provided, as a user interface unit 40, are a synthesis character string input unit 32, the speech synthesis unit 12, and the acceptance/rejection judgment input unit 27. The synthesis character string input unit 32 accepts input of character string information; it accepts text data inputted for example through a keyboard, optical character reader, or other input device, or text data recorded on a recording medium. The speech synthesis unit 12 outputs a generated speech waveform, and can be constituted by a variety of speakers and speech output software. The acceptance/rejection judgment input unit 27 accepts input of a user's appropriate/inappropriate judgment with respect to a speech segment combination, displaying on a monitor a selection for appropriate or inappropriate, and acquiring data of appropriate or inappropriate as selected using a keyboard, mouse or other pointing device.

The linguistic analysis unit 33 assigns pronunciation and accents to the text input from the synthesis character string input unit 32, and generates a speech unit sequence (synthesis target phoneme sequence) using morphemic and syntactic analysis and the like.

The prosody generating unit 34 generates intonation and rhythm for generation of synthesized speech for a synthesis target phoneme sequence, determining, for example, pitch frequency pattern, duration of each speech unit, power fluctuation pattern and the like.

The speech segment selection unit 21, as explained in the principle constitution above, selects from the speech segment storage unit 13 speech segment that satisfies synthesis parameters such as synthesis target phoneme sequence, pitch frequency pattern, speech unit duration, and power fluctuation pattern. The speech segment selection unit 21 is constituted so that, at this time, if a speech segment combination that matches synthesis parameters is stored in the speech segment selection information storage unit 24, this speech segment combination is given priority in selection. If no speech segment combination that matches synthesis parameters is stored in the speech segment selection information storage unit 24, the speech segment selection unit 21 selects the speech segment combination dynamically found to be most appropriate according to an evaluation function. This constitution assumes that no inappropriate speech segment selection information is registered in the speech segment selection information storage unit 24.

The speech synthesis unit 12 generates and outputs a speech waveform based on the speech segment combination selected by the speech segment selection unit 21.

When there are a plurality of potential speech segment combinations that the speech segment selection unit 21 has selected based on an evaluation function, the respective speech waveforms are output via the speech synthesis unit 12, and a user's appropriate/inappropriate judgment is accepted at the acceptance/rejection judgment input unit 27. Appropriate/inappropriate information input by the user and accepted through the acceptance/rejection judgment input unit 27 is reflected in speech segment selection information stored in the speech segment selection information storage unit 24 via the speech segment selection information editing unit 26.

Figure 7A:
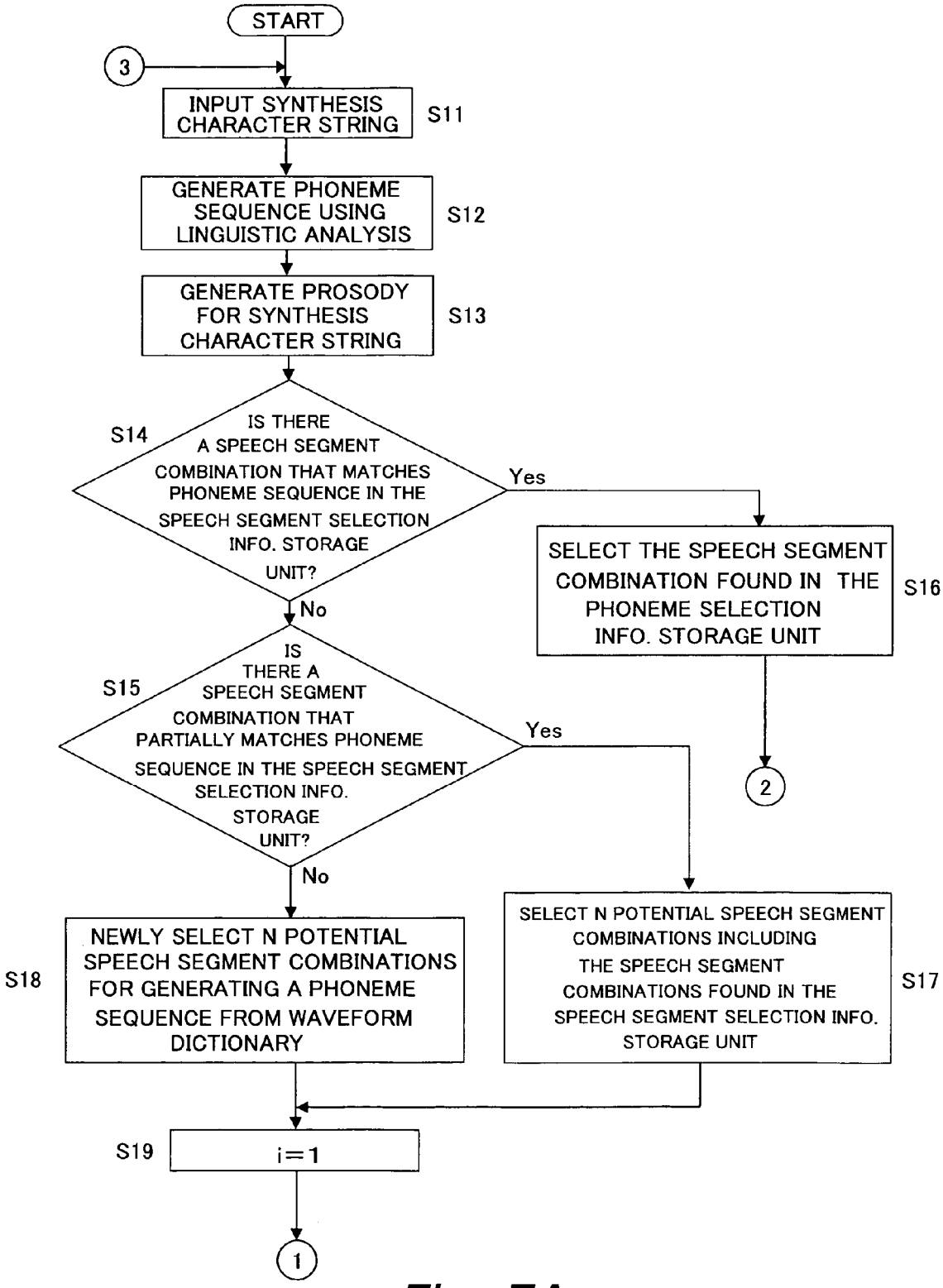
FIG. 7A and B is a control flowchart for a first embodiment of the present invention.
Figure 7B:
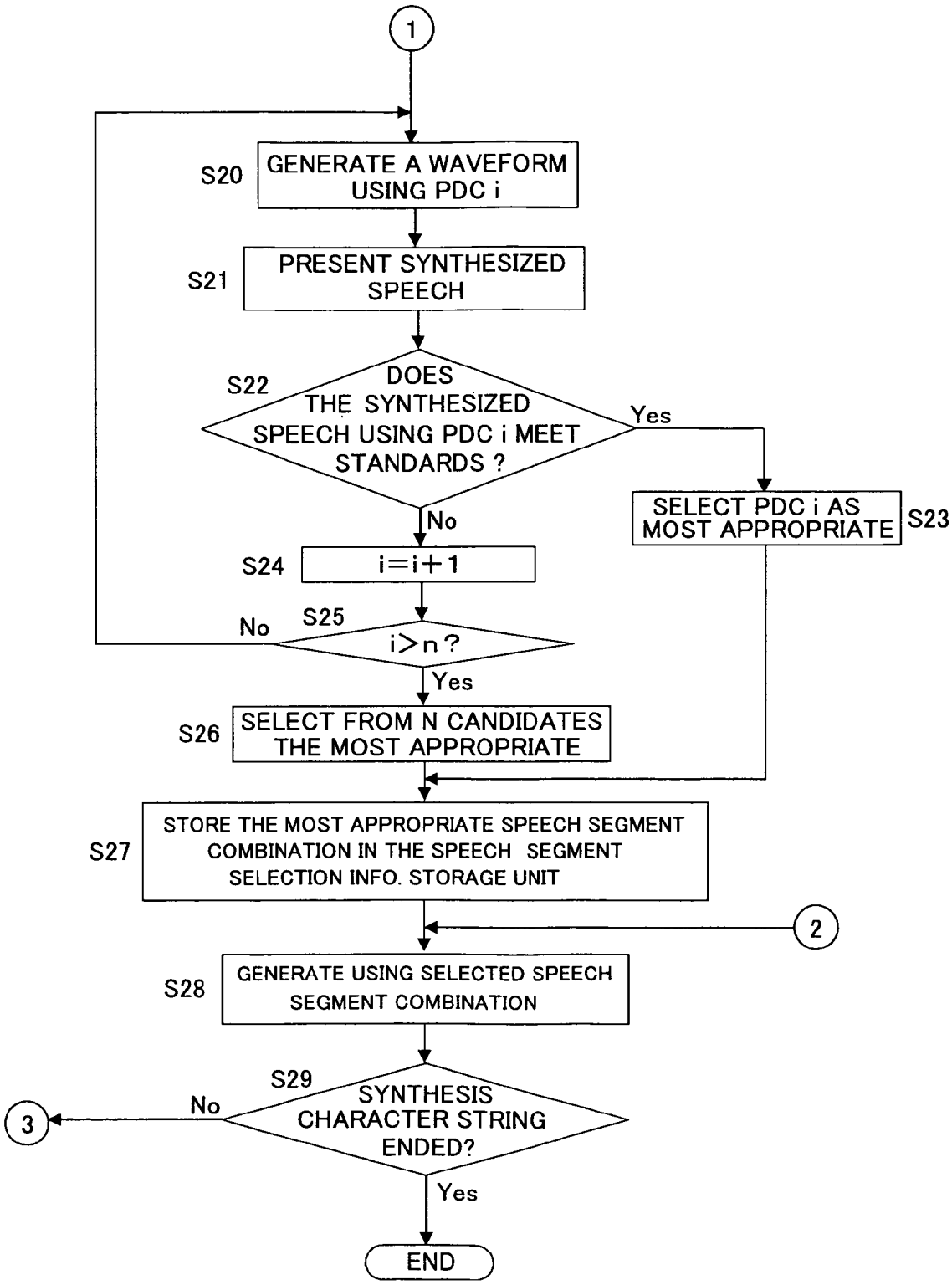

The operations of this speech synthesis system will be explained with reference to the flow chart of FIG. 7A and 7B; in this case, only appropriate speech segment selection information is registered in the speech segment selection information storage unit 24.

In Step S11 , text data input from the synthesis character string input unit 32 is accepted.

In Step S12, input text data is analyzed by the linguistic analysis unit 33 and a synthesis target phoneme sequence is generated.

In Step S13, prosody information, such as a pitch frequency pattern, speech unit duration, power fluctuation pattern and the like for the generated synthesis target phoneme sequence is generated at the prosody generation unit 34.

In Step S14, determination is made with respect to whether speech segment selection information for a phoneme sequence that matches the synthesis target phoneme sequence is stored in the speech segment selection information storage unit 24. If it is determined that speech segment selection information for a phoneme sequence that matches the synthesis target phoneme sequence is present, control proceeds to Step S16; if it is determined otherwise, control proceeds to Step S15.

In Step S16, based on speech segment selection information stored in the speech segment selection information storage unit 24, a speech segment combination stored in the speech segment storage unit 13 is selected, and control proceeds to Step S28.

In Step S15, determination is made of whether speech segment selection information for a phoneme sequence that matches a portion of the synthesis target phoneme sequence is stored in the speech segment selection information storage unit 24. If it is determined that speech segment selection information for a phoneme sequence that matches a portion of the synthesis target phoneme sequence is stored in the speech segment selection information storage unit 24, control proceeds to Step S17; if it is determined otherwise, control proceeds to Step S18.

In Step S17, n potential speech segment combinations are selected from speech segment selection information for a phoneme sequence that includes a portion of the synthesis target phoneme sequence, and then control proceeds to Step S19.

In Step S18, n potential speech segment combinations for generating a synthesis target phoneme sequence are selected based on an evaluation function (waveform dictionary), and control proceeds to Step S19.

In Step S19, the variable (i) for carrying out appropriate/inappropriate judgment with respect to selected speech segment combinations is set at an initial value of 1.

In Step S20, a speech waveform according to the no. (i) speech segment combination is generated.

In Step S21, the generated speech waveform is output via the speech synthesis unit 12.

In Step S22, an appropriate/inappropriate judgment is accepted from a user with respect to the synthesized speech output from the speech synthesis unit 12. If a user inputs as appropriate/inappropriate information "appropriate," control proceeds to Step S23; otherwise control proceeds to Step S24.

In Step S23, speech segment combination no. (i) currently selected is designated as "most appropriate" and control proceeds to Step S27.

In Step S24, the variable (i) is incremented by one.

In Step S25, determination is made whether the value of the variable (i) has exceeded n. If the value of the variable (i) is n or less, control proceeds to Step S20 and repeats the same operations; if it is determined that the value of the variable (i) has exceeded n, control proceeds to Step S26.

In Step S26, the most appropriate of the n potential speech segment combinations is selected. Here, the system may be constituted so that the n potential speech segment combinations are displayed on a monitor, and a user is asked to choose; alternatively, a constitution is possible where a speech segment combination determined to be most appropriate based on an evaluation function and other parameters is selected.

In Step S27, the speech segment combination judged to be most appropriate is stored in the speech segment selection information storage unit 24 as speech segment selection information for the synthesis target phoneme sequence.

In Step S28, a speech waveform is generated based on the selected speech segment combination.

In Step S29, determination is made whether the synthesis character string has ended. If the synthesis character string has not ended, control proceeds to Step S11 and the same operations are repeated; otherwise, this routine is ended.

Figure 8:
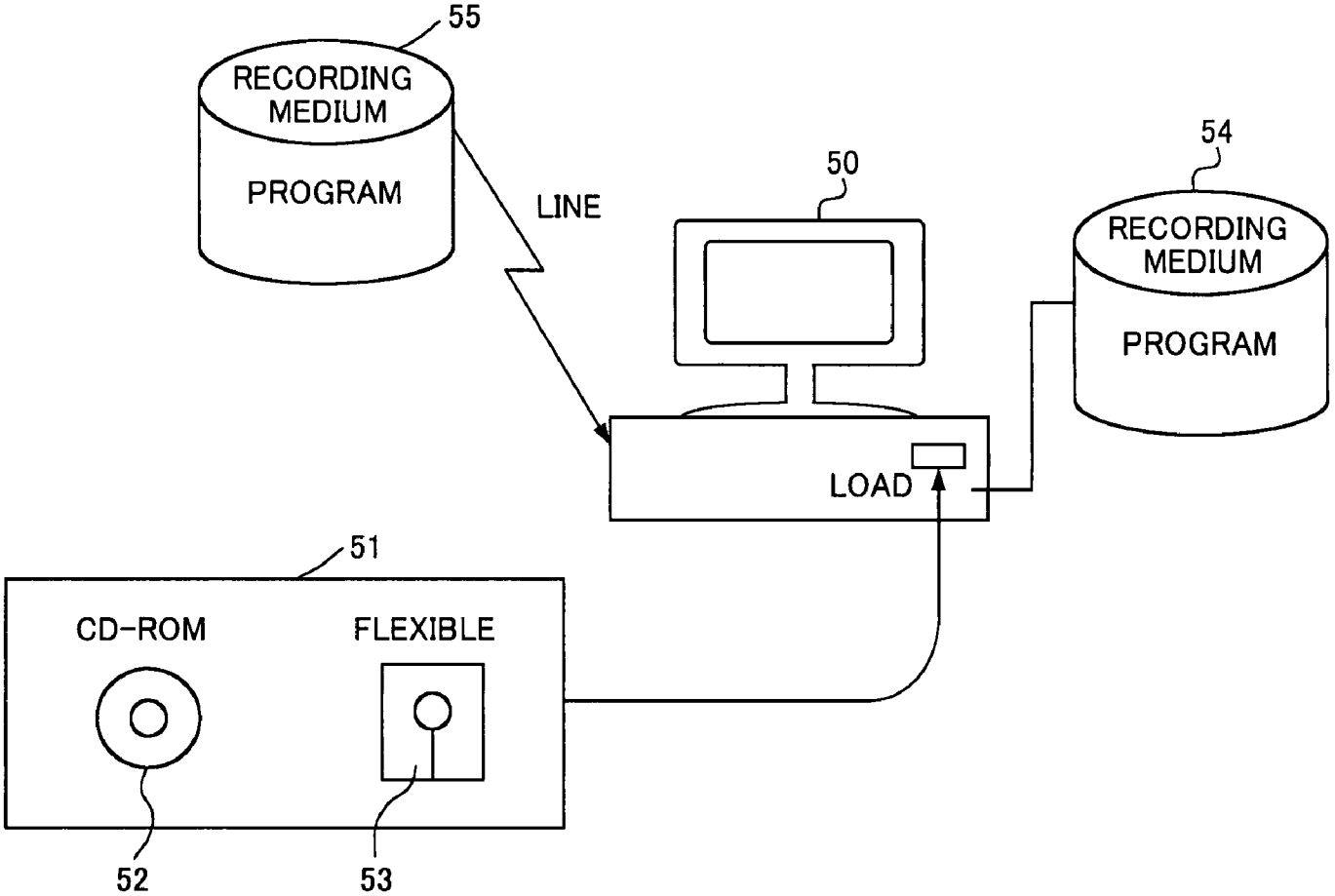
FIG. 8 is a drawing for describing recording media which stores a program according to the present invention.

A speech synthesis system according to an embodiment of the present invention and a program for realizing the speech synthesis method may, as shown in FIG. 8, be recorded on a portable recording medium 51 such as a CD-Rom 52 or flexible disc 53, on another recording device 55 provided at the end of a communication line, or a recording medium 54 such as a hard disk or RAM of a computer 50. This data is read by the computer 50 when using the speech synthesis system of the present invention.

Also as shown in FIG. 8, the various types of data generated by a speech synthesis system according to the present invention may be recorded not only on a portable recording medium 51 such as a CD-Rom 52 or flexible disc 53, but also on another recording device 55 provided at the end of a communication line, and on a recording medium such as a hard disk or RAM of a computer 50.

Industrial Applicability

In accordance with the present invention, in a speech synthesis system wherein speech segment is selected from speech data such as sentences and words spoken by a person and concatenated, growth in volume of speech segment can be restrained and quality of synthesized speech improved.

Further, a framework is provided for a user, using the system, to create the most appropriate synthesized speech; for a system developer, there is no longer need to consider fine-tuning an evaluation function so that it can be used in all cases, reducing the energy spent on development and maintenance.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. A speech synthesis system wherein synthesis parameters necessary for speech synthesis are input, and a speech segment combination matching said synthesis parameters is selected from a speech segment inventory and concatenated, thereby generating and outputting a speech waveform for said synthesis parameters, comprising:

a speech segment storage unit that stores said speech segment;

a speech segment selection information storage unit that, with respect to a given speech unit sequence, correlates with the speech unit sequence information regarding appropriateness of a combination of speech segment data to be selected from among a plurality of speech segment data stored in said speech segment storage unit that synthesizes the speech unit sequence and that stores speech segment selection information;

a speech segment selection unit that selects a speech segment combination that is most appropriate for said synthesis parameters from said speech segment storage unit based on speech segment selection information stored in said speech segment selection information storage unit; and a speech synthesis unit that generates and outputs speech waveform data based on a speech segment combination selected by said speech segment selection unit.

2. A speech synthesis system according to claim 1, wherein said speech segment selection unit, in cases where speech segment selection information to the effect that a speech unit sequence matching the synthesis target speech unit sequence included in the input synthesis parameters and having the most appropriate speech segment combination is included in the speech segment selection information storage unit, selects such speech segment combination, and in cases where speech segment selection information to the effect that a speech unit sequence matching the synthesis target speech unit sequence included in the input synthesis parameters and having the most appropriate speech segment combination is not included in the speech segment selection information storage unit, prescribed selection means is used to create potential combinations of speech segment from the speech segment storage unit.

3. A speech synthesis system according to claim 2, further comprising:

an acceptance/rejection judgment accepting unit that accepts a user's judgment of appropriate/inappropriate with respect to a potential speech segment combination created at the speech segment selection unit; and a speech segment selection information editing unit that stores in the speech segment selection information storage unit speech segment selection information including a speech segment combination created using speech segment stored in said speech segment storage unit and information regarding appropriateness thereof, such storing to be based upon a user's appropriate/inappropriate judgment received at said acceptance/rejection judgment accepting unit.

4. A speech synthesis method wherein synthesis parameters necessary for speech synthesis are input, and a speech segment combination matching said synthesis parameters is selected from a speech segment inventory and concatenated, thereby generating and outputting a speech waveform for said synthesis parameters, the method comprising:

storing said speech segment;

storing speech segment selection information with respect to a given speech unit sequence, wherein storing speech segment selection information includes correlating with the speech unit sequence information regarding appropriateness of a combination of speech segment data to be selected from among a plurality of speech segment data stored as speech segment selection information, synthesizing the speech unit sequence, and storing speech segment selection information; selecting a speech segment combination that is most appropriate for said synthesis parameters based on stored speech segment selection information; and generating and outputting speech waveform data based on the selected speech segment combination.

5. A speech synthesis method according to claim 4, further comprising:

creating with respect to a given synthesis target speech unit sequence a potential speech segment combination constituted by stored speech segment;

accepting a user's judgment of appropriate/inappropriate with respect to the potential speech segment combination created using stored speech segment; and storing speech segment selection information including said speech segment combination and information regarding appropriateness thereof, based upon a user's appropriate/inappropriate judgment.

6. A computer-readable storage medium encoded with processing instructions for causing a processor to execute a speech synthesis method, wherein synthesis parameters necessary for speech synthesis are input, and a speech segment combination matching said synthesis parameters is selected from a speech segment inventory and concatenated, thereby generating and outputting a speech waveform for said synthesis parameters, the method comprising:

storing said speech segment;

storing speech segment selection information with respect to a given speech unit sequence, wherein storing speech segment selection information includes correlating with the speech unit sequence information regarding appropriateness of a combination of speech segment data to be selected from among a plurality of speech segment data stored as speech segment selection information, synthesizing the speech unit sequence, and storing speech segment selection information;

selecting a speech segment combination that is most appropriate for said synthesis parameters based on stored speech segment selection information; and generating and outputting speech waveform data based on said speech segment combination.

* * * * *